US006504324B1

(12) United States Patent
Amano et al.

(10) Patent No.: US 6,504,324 B1
(45) Date of Patent: Jan. 7, 2003

(54) COLOR-CATHODE-RAY-TUBE ELECTRON GUN AND COLOR CATHODE-RAY TUBE

(75) Inventors: Yasunobu Amano, Tokyo; Makoto Natori, Kanagawa, both of (JP)

(73) Assignee: Sony Corporation (JP)

( * ) Notice: Subject to any disclaimer, the term of this patent is extended or adjusted under 35 U.S.C. 154(b) by 176 days.

(21) Appl. No.: 09/598,224

(22) Filed: Jun. 21, 2000

(30) Foreign Application Priority Data

Jun. 22, 1999 (JP) ..... 11-175745

(51) Int. Cl.[7] ..... G09G 1/04

(52) U.S. Cl. ..... 315/370; 315/368.18; 315/368.21

(58) Field of Search ..... 315/382, 382.1, 315/1, 15, 368.11, 368.15, 368.18, 368.21, 370, 371; 313/412, 414, 426, 428, 449

(56) References Cited

U.S. PATENT DOCUMENTS 4,771,216 A * 9/1988 Blacker et al. ..... 315/15
4,886,999 A * 12/1989 Yamane et al. ..... 313/414
4,922,166 A * 5/1990 Ichida et al. ..... 313/412
5,399,946 A * 3/1995 Son et al. ..... 315/382
5,763,993 A * 6/1998 Park et al. ..... 313/412
6,172,450 B1 * 1/2001 Natori et al. ..... 313/412

FOREIGN PATENT DOCUMENTS

JP Hei 01-232643 9/1989
JP Hei P11-067120 8/1997
JP Hei 11-149885 6/1999

* cited by examiner

*Primary Examiner*—Haissa Philogene
(74) *Attorney, Agent, or Firm*—Rader, Fishman & Grauer PLLC; Ronald P. Kananen, Esq.

(57) ABSTRACT

A color-cathode-ray-tube electron gun of the present invention comprises a three-divided first focus electrode and a second focus electrode set so as to oppose the first focus electrode: wherein a parabolic-waveform voltage synchronizing with horizontal scanning is applied to the second focus electrode; of the three-divided focus electrodes, a built-in resistor electrically connecting the central electrode and the both outside electrodes is provided; a voltage on which a first voltage component having a waveform similar to serration and synchronizing with horizontal scanning, and a second voltage component having a parabolic waveform convex in the direction opposite to the parabolic waveform and synchronizing with horizontal scanning are superimposed is applied to the central electrode, and a voltage obtained by passing the voltage on which the first voltage component and second voltage component are superimposed through the built-in resistor is applied to the both outside electrodes. According to the present invention it is possible to reduce influences due to crosstalk between electrodes and uniform spot shapes of three electron beams at the right and left ends of a fluorescent screen as much as possible.

8 Claims, 13 Drawing Sheets

COLOR-CATHODE-RAY-TUBE ELECTRON GUN AND COLOR CATHODE-RAY TUBE

BACKGROUND OF THE INVENTION

1. Field of the Invention

The present invention relates to an in-line-three-beam-system color-cathode-ray-tube electron gun used for a color cathode-ray tube constituting a color picture tube or a color display unit and a color cathode-ray tube provided with the electron gun.

2. Description of the Related Art

A request for better resolution of a color cathode-ray tube is increasingly raised at present. Particularly, a problem of a spot shape of an electron beam around a screen is greatly focused on.

Moreover, a problem that preferable shapes of three electron beams cannot be obtained at the same time because a focus-voltage difference occurs between the three electron beams around a screen is particularly noticed.

This causes a generally observed phenomenon that a red character becomes unclear on the right side of a screen of a display monitor and a blue character becomes unclear at the left side of the screen.

To solve the above problem, a color-cathode-ray-tube electron gun having so-called built-in quadrupole lens is proposed.

FIG. 1 shows a schematic block diagram of a generally-widely-used, color-cathode-ray-tube electron gun having a built-in quadrupole lens.

The electron gun 70 has three cathodes $K_R$, $K_G$, and $K_B$ in-line-arranged in parallel, and a first electrode 11, a second electrode 12, a third electrode 13, a fourth electrode 14, a fifth electrode, a sixth electrode 16, and a shield cup 17 are coaxially arranged in order from the cathodes ($K_R$, $K_G$, and $K_B$) toward an anode. Moreover, the fifth electrode is divided into a (5-1)th electrode 51 and a (5-2)th electrode 52. Furthermore, the second electrode 12 and the fourth electrode 14 are electrically connected to each other.

In the case of the color-cathode-ray-tube electron gun 70, a fixed-focus voltage (first focus voltage) Ef1 is applied to the third electrode 13 and the (5-1)th electrode 51 through a stem portion.

Moreover, a second focus voltage Ef2, on which a parabolic(so-called parabola-shaped)-waveform voltage horizontally-deflectively synchronizing with the first focus voltage Ef1 is superimposed, is applied to the (5-2)th electrode 52.

Thereby, a quadrupole lens (not illustrated) is formed between the (5-1)th electrode 51 and the (5-2)th electrode 52 and, moreover, the quadruole lens causes an intensity change in a focus lens (not illustrated) formed between the (5-2)th electrode 52 and the sixth electrode 16.

As a result, it is possible to form electron beams in the peripheral portions in the right and left directions of a fluorescent screen into preferable shapes.

FIG. 2 shows a schematic view of a color cathode-ray tube.

As shown in FIG. 2, three electron beams R, G, and B emitted from an electron gun 1 and colliding with circumferential portions of a fluorescent screen on the right and left sides are located away from each other in a magnetic field of a deflection yoke. Therefore, the directions and intensities of a magnetic field received by three electron beams are different from each other.

Therefore, the distortion states of electron beam spots at the right and left circumferential portions of the fluorescent screen 4 are different from each other among three electron beams R, G, and B. In FIG. 2, symbol 3 denotes a glass bulb. Moreover, "Right Side of Screen" and "Left Side of Screen" denote the right side and the left side of the fluorescent screen 4 of the color cathode-ray tube when observing the screen 4 from the outside.

The focus voltage is usually set so that the shape of the spot of the central electron beam G among three electron beams R, G, and B becomes optimum.

In this case, when the three electron beams R, G, and B collide with the right side of the fluorescent screen 4, the red electron beam R passes through further outside of a deflection magnetic field formed by the deflection yoke 2 than the electron beams G and B and is greatly influenced by the deflection magnetic field. As a result, the distortion of the beam spot of the electron beam R on the fluorescent screen 4 becomes larger than those of the electron beams G and B.

Moreover, when the three electron beams R, G, and B collide with the left side of the fluorescent screen 4, the blue electron beam B passes through further outside of a deflection magnetic field formed by the deflection yoke 2 than the electron beams G and R and is greatly influenced by the deflection magnetic field. As a result, the distortion of the beam spot of the electron beam B on the fluorescent screen 4 becomes larger than those of the electron beams R and G.

Therefore, in the case of a display monitor, particularly a recent, large, color-display monitor having a high resolution, a phenomenon occurs that a red character becomes unclear at the right side of a screen and a blue character becomes unclear at the left side of the screen, as described above.

It can be said that the phenomenon occurs because a difference is produced around a screen among focus voltages of three electron beams R, G, and B.

Therefore, as one of the means for solving the problems, a color-cathode-ray-tube electron gun his been previously proposed which provides lens effects different in intensity for a red electron beam R and a blue electron beam B (refer to Japanese Patent Laid-Open Nos. Hei 11-067120 and Hei 11-149885).

FIG. 3 shows an electrode arrangement of a configuration of the above previously-proposed, color-cathode-ray-tube electron gun.

The electron gun 50 has three cathodes $K_R$, $K_G$, and $K_B$ in-line-arranged in parallel, and a first electrode 11, a second electrode 12, a third electrode 13, a fourth electrode 14, a fifth electrode (to be described later), a sixth electrode 16, and a shield cup 17 are coaxially arranged in order from the cathodes ($K_R$, $K_G$, and $K_B$) toward an anode. Moreover, the second electrode 12 and the fourth electrode 14 are electrically connected to each other.

The fifth electrode corresponding to a focus electrode is divided into a (5-1)th electrode 51 and a (5-2)th electrode 52. Moreover, the (5-1)th electrode 51 is divided into a (5-1A)th electrode 51A, (5-1B)th electrode 51B, and a (5-1C)th electrode 51C.

A first quadrupole lens is constituted by the (5-1A)th electrode 51A, the (5-B)th electrode 51B, and the (5-1C)th electrode 51C, and a second quadrupole lens is constituted by the (5-1C)th electrode 51C and the (5-2)th electrode 52. Moreover, the quadruple-electrode action of the second quadrupole lens is controlled by the first quadrupole lens.

A fixed focus voltage (first focus voltage) Ef1 is applied to the third electrode 13 and the (5-1A)th electrode 51A and the (5-1C)th electrode 51C outside of the three-divided (5-1)th electrode 51. A third focus voltage Ef3 on which a voltage having a waveform voltage having a shape similar to serration synchronizing with horizontal deflection (refer to FIG. 4) and the fixed focus voltage Ef1 are superimposed is applied to the (5-1B)th electrode 51B. Moreover, a second focus voltage Ef2 on which a parabolic-waveform voltage synchronizing with horizontal deflection (refer to FIG. 4) and the fixed focus voltage Ef1 are superimposed is applied to the (5-2)th electrode 52.

These three focus voltages Ef1, Ef2, and Ef3 are normally supplied from a system portion at the front end of the electron gun 50.

A waveform of the third focus voltage Ef3 can be a waveform having a shape similar to the serration shown and linearly changing, as shown in FIG. 5A, or a sinusoidal waveform intermittently generated every horizontal deflection cycle, as shown in FIG. 5B.

The (5-1A)th electrode 51A, the (5-1)th electrode 51B, and the (5-1C)th electrode 51C are respectively provided with three electron-beam passing bores.

In the case of the above previously-proposed, color-cathode-ray-tube electron gun, it is possible to independently control deflection magnetic fields covering three electron beams R, G, and B by each electron beam by improving the shapes of the bores through which electron beams of the (5-1)th electrodes 51A, 51B, and 51C pass. By independently controlling the deflection magnetic fields, a difference between convergence effects of electron beams is canceled, preferable shapes of three electron beams are obtained around a screen, and the phenomenon that red is deteriorated on the right side of a screen and blue is deteriorated on the left side of the screen is eliminated.

In the case of the above method, however, its effect cannot be completely made the most of unless three types of focus voltages, that is, the fixed focus voltage Ef1, the parabolic-waveform voltage Ef2, and the serrated-waveform voltage Ef3 are independently adjusted. Therefore, adjustment is complex compared with the case of the conventional electron gun shown in FIG. 18 in which two types of focus voltages Ef1 and Ef2 only have to be adjusted.

Therefore, the present applicant proposes an electron gun having a constitution of applying the voltage obtained by passing the serrated-waveform voltage Ef3 through a built-in resistor to the (5-1A)th electrode 51A and the (5-1C)th electrode 51C instead of connecting the built-in resistor between the (5-1A)th electrode 51A and the (5-1C)th electrode 51C on one hand and the (5-1B)th electrode 51B on the other and applying the fixed focus voltage f1.

Thereby, the number of focus voltages to be adjusted is decreased to such two voltages as the parabolic-waveform voltage Ef2 and serrated-waveform voltage Ef3, and it is possible to avoid a complicated adjustment.

In the case of the method for supplying a voltage through a built-in resistor, however, a problem may occur that that electric potential is fluctuated due to crosstalk between electrodes and, thereby, a desired electric potential cannot be applied to an electrode differently from the case of directly applying a voltage to an electrode.

As a result, a quadrupole-lens action which should occur only at the right and left ends of a screen occurs at the center and the Y-axis ends (central upper and lower portions) of the screen, and, particularly, a phenomenon occurs that the focus characteristic at the Y-axis ends of the screen is deteriorated.

SUMMARY OF THE INVENTION

To solve the above problems, the present invention provides an in-line-three-beam-type, color-cathode-ray-tube electron gun and a color cathode-ray tube capable of reducing influences due to crosstalk between electrodes and uniforming spot shapes of three electron beams at the right and left ends of a fluorescent screen as much as possible.

A color-cathode-ray-tube electron gun of the present invention comprises a thrice-divided first focus electrode and a second focus electrode set so as to oppose the first focus electrode: wherein a parabolic-waveform voltage synchronizing with horizontal scanning is applied to the second focus electrode; of the thrice-divided focus electrodes, a built-in resistor electrically connecting the central electrode and both outside electrodes is provided, a voltage on which a first voltage component having a waveform similar to a serration and synchronizing with horizontal scanning, and a second voltage component having a parabolic waveform convex in the direction opposite to the parabolic waveform and synchronizing with horizontal scanning are superimposed is applied to the central electrode, and a voltage obtained by passing the voltage on which the first voltage component and second voltage component are superimposed through the built-in resistor is applied to both outside electrodes.

A color cathode-ray tube of the present invention is constituted by being equipped with the color-cathode-ray-tube electron gun having the above configuration.

According to the color-cathode-ray-tube electron gun and color cathode-ray tube of the present invention, because the voltage obtained by passing the voltage on which the first voltage component and second voltage component are superimposed through the built-in resistor is applied to both outside electrodes of the first focus electrode, a component obtained by passing the second voltage component convex in the opposite direction to the parabolic waveform of the voltage to be applied to the second focus electrode is applied to the both outside electrodes. The component makes it possible to offset the influences of crosstalk from the second focus electrode to which a parabolic-waveform voltage is applied to both outside electrodes.

DESCRIPTION OF THE PREFERRED EMBODIMENTS

Figure 1:
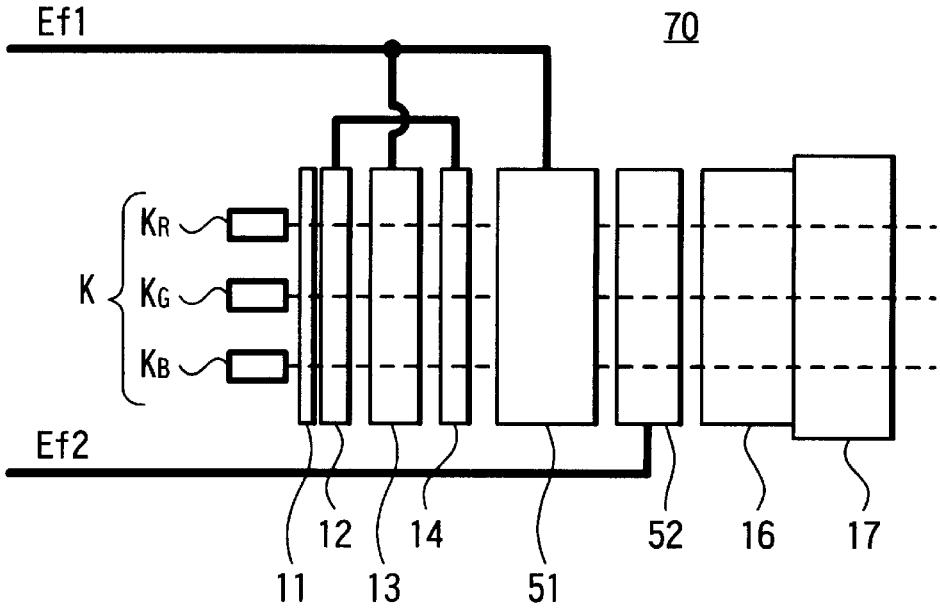
FIG. 1 is a schematic block diagram of a conventional color-cathode-ray-tube electron gun having a built-in quadrupole lens.

The present invention uses a color-cathode-ray-tube electron gun comprising a thrice-divided first focus electrode and a second focus electrode set so as to oppose the first focus electrode, wherein a parabolic-waveform voltage synchronizing with horizontal scanning is applied to the second focus electrode, a built-in resistor electrically connecting the central electrode and both outside electrodes of the thrice-divided first focus electrode is included, a voltage on which a first voltage component having a waveform similar to a serration and synchronizing with horizontal scanning and a second voltage component having a parabolic waveform which is convex in the opposite direction to the former parabolic waveform are superimposed is applied to the central electrode and a voltage obtained by passing a voltage on which the first voltage component and the second voltage component are superimposed through the built-in resistor is applied to both outside cells.

Moreover, the present invention uses the color-cathode-ray-tube electron gun constituted so that in the thrice-divided focus electrode, one of the bores through which two outside electron beams among three electron beams pass is formed into a horizontally-long astigmatic shape and the other of the bores is formed into a vertically-long astigmatic shape by the opposing divided focus electrodes, and inside of the same focus electrode, one of the bores through which the outside electron beams pass is formed into a horizontally-long astigmatic shape and the other of the bores through which the outside electron beams pass is formed into a vertically-long astigmatic shape.

Furthermore, the present invention uses the color-cathode-ray-tube electron gun constituted so that in the thrice-divided focus electrode, one of the bores through which two outside electron beams among three electron beams pass is formed so as to have a large diameter and the other of the bores is formed so as to have a small diameter by the opposing divided focus electrode, and inside of the same focus electrode, one of the bores through which the outside electron beams pass is formed so as to have a large diameter and the other of the bores through which the outside electron beams pass is formed so as to have a small diameter.

Furthermore, the present invention uses the color-cathode-ray-tube electron gun constituted so that in the thrice-divided focus electrodes, one of the electrodes around bores through which two outside electron beams among three electron beams pass is formed thick and the other of the electrodes around the bores is formed thin by the opposing divided focus electrode, and inside of the same focus electrode, the periphery of one of the bores through which the outside electron beams pass is formed thick and the periphery of the other of the bores through which the outside electron beams pass is formed thin.

The present invention uses a color cathode-ray tube constituted by having an electron gun comprising a thrice-divided first focus electrode and a second focus electrode set so as to oppose the first focus electrode, wherein a voltage having a parabolic waveform synchronizing with horizontal scanning is applied to the second focus electrode, a built-in resistor is provided which electrically connects a central electrode and both outside electrodes among the thrice-divided first focus electrodes, a voltage on which a first voltage component having a waveform similar to a serration and synchronizing with horizontal scanning and a second voltage component having a parabolic waveform which is convex in the opposite direction to the former parabolic waveform are superimposed is applied to the central electrode, and a voltage obtained by passing a voltage on which the first voltage component and the second voltage component are superimposed through the built-in resistor is applied to both outside electrodes.

Moreover, the present invention uses the color cathode-ray tube constituted so that in the thrice-divided focus electrode, one of the bores through which two outside electron beams among three electron beams pass is formed into a horizontally-long astigmatic shape and the other of the bores is formed into a vertically-long astigmatic shape by the opposing divided focus electrodes, and inside of the same focus electrode, one of the bores through which the outside electron beams pass is formed into a horizontally-long astigmatic shape and the other of the bores through which the outside electron beams pass is formed into a vertically-long astigmatic shape.

Furthermore, the present invention uses the color cathode-ray tube constituted so that in the thrice-divided focus electrodes, one of the bores through which two outside electron beams among three electron beams pass is formed so as to have a large diameter and the other of the bores is formed so as to have a small diameter by the opposing divided focus electrode, and inside of the same focus electrode, one of the bores through which the outside electron beams pass is formed so as to have a large diameter and the other of the bores through which the outside electron beams pass is formed so as to have a small diameter.

Furthermore, the present invention uses the color cathode-ray tube constituted so that in the thrice-divided focus electrodes, one of the electrodes around bores through which two outside electron beams among three electron beams pass is formed thick and the other of the electrodes around the bores is formed thin by the opposing divided focus electrode, and inside of the same focus electrode, the periphery of one of the bores through which the outside electron beams pass is formed thick and the periphery of the other of the bores through which the outside electron beams pass is formed thin.

Figure 6:
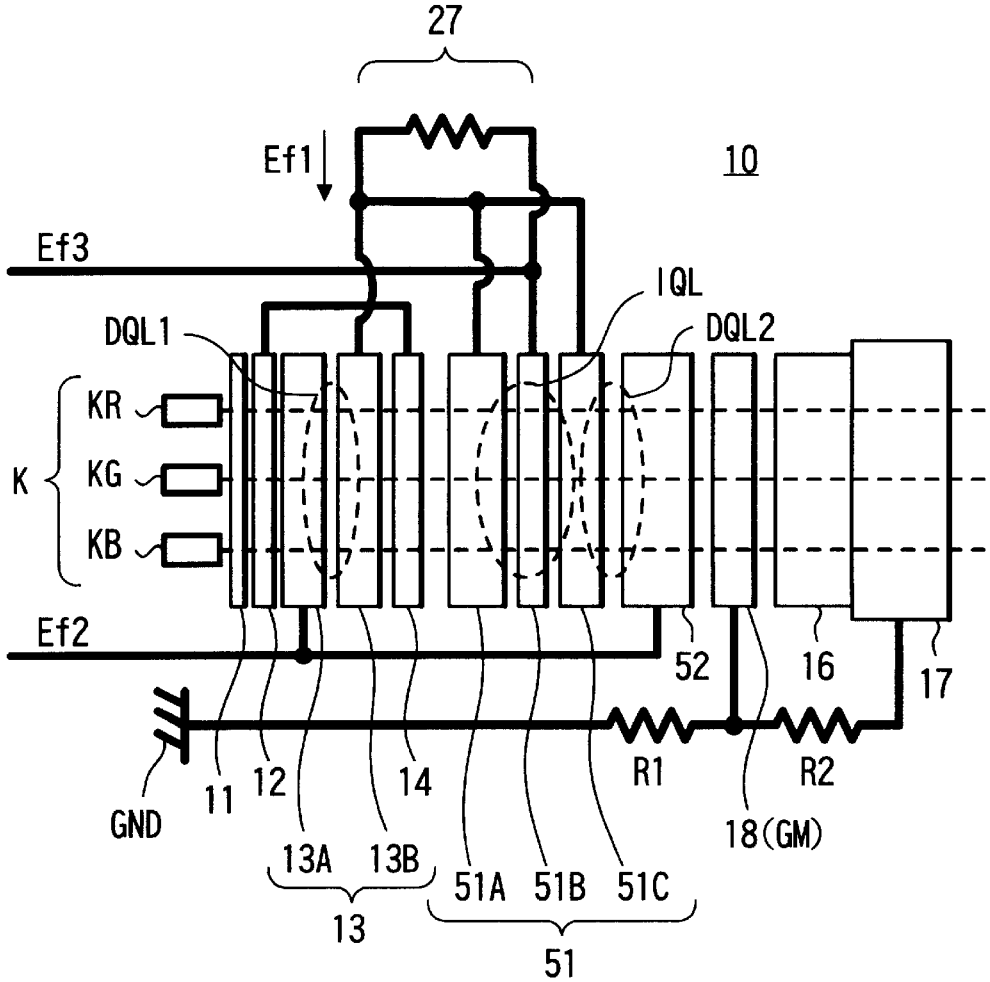
FIG. 6 is a diagram showing an electrode arrangement of the color-cathode-ray-tube electron gun of an embodiment of the present invention.

FIG. 6 shows an electrode arrangement of the color-cathode-ray-tube electron gun of an embodiment of the present invention.

Figure 2:
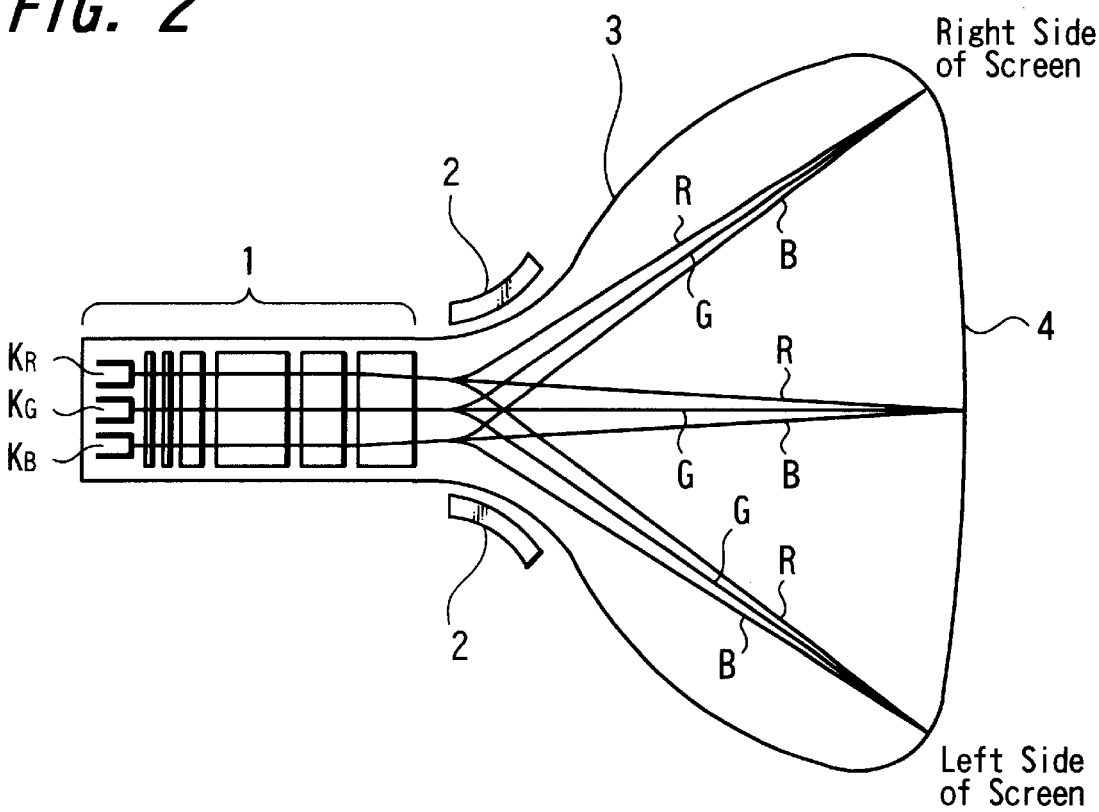
FIG. 2 is a schematic view of a color cathode-ray tube.
Figure 3:
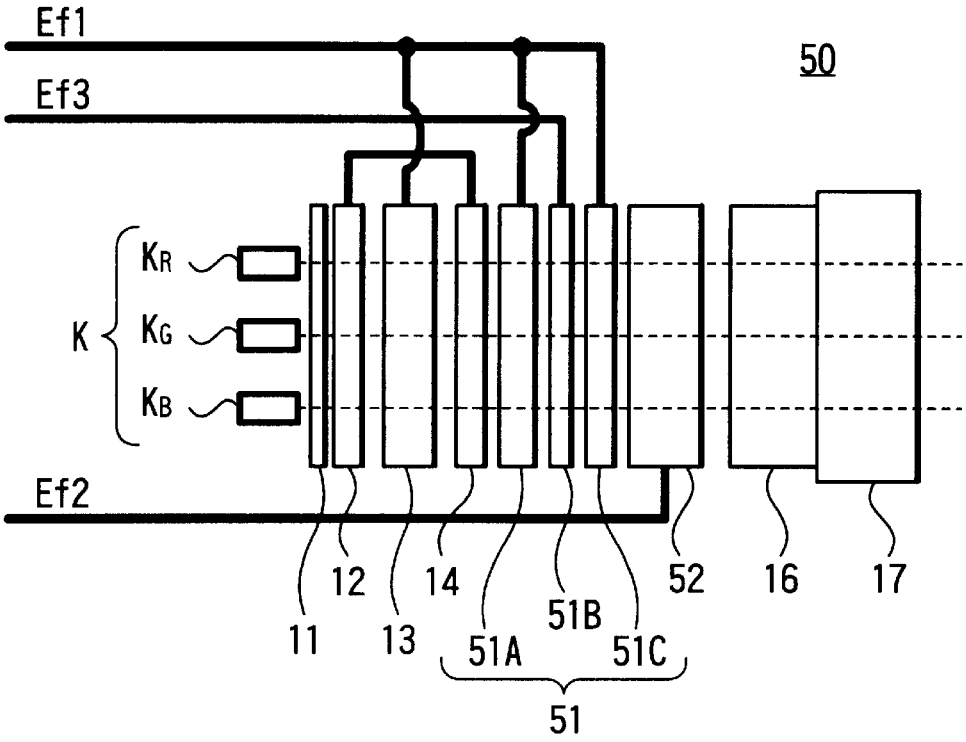
FIG. 3 is a schematic block diagram of the color-cathode-ray-tube electron gun previously proposed.

It is possible to constitute a color cathode-ray tube having the same configuration as that of the color cathode-ray tube shown in FIG. 2 by the color-cathode-ray-tube electron gun 10 in FIG. 6.

The electron gun 10 has three cathodes $K_R$, $K_G$, and $K_B$ in-line-arranged in parallel, in which a first electrode 11, a second electrode 12, a third electrode 13, a fourth electrode 14, a fifth electrode, a sixth electrode 16, and a shield cup 17 are arranged in order from the cathodes K ($K_R$, $K_G$, and $K_B$) toward an anode.

The second electrode 12 and the fourth electrode 14 are electrically connected to each other. Moreover, an intermediate electrode (GM) 18 to which an intermediate potential is applied is arranged between the fifth electrode and the sixth electrode.

The third electrode 13 is divided into a (3-1)th electrode 13A and a (3-2)th electrode 13B. A first dynamic quadrupole lens DQL1 is constituted by the (3-1)th electrode 13A and the (3-2)th electrode 13B.

Moreover, the fifth electrode corresponding to a focus electrode is divided into two electrodes, such as the (5-1)th electrode 51 serving as a first focus electrode and the (5-2)th electrode 52 serving as a second focus electrode. Furthermore, the (5-1)th electrode 51 is divided into three electrodes such as a (5-1A)th electrode 51A, a (5-1B)th electrode 51B, and (5-1C)th electrode 51C.

A voltage, such as 0 V (or tens of V), is applied to the first electrode 11, a voltage of 200 to 800 V is applied to the second electrode 12 and fourth electrode 14, and an anode voltage of 22 KV to 30 KV is applied to the sixth electrode 16.

An intermediate voltage, such as 14 KV, obtained by dividing an anode voltage by two resistors R1 and R2 is applied to the intermediate electrode 18 to generate an electric-field-expanding lens action. Thereby, it is possible to make the potential gradient gentle between the sixth electrode 16 and the (5-2)th electrode 52 and decrease the influences of spherical aberration on an electron beam. Therefore, it is possible to improve a spot shape on the entire screen.

Moreover, a third focus voltage Ef3 to be described later is applied to the central (5-1B)th electrode 51B of the thrice-divided (5-1)th electrode 51 as a dynamic focus voltage.

A second focus voltage Ef2 to be described later is applied to the (5-2)th electrode 52 as another dynamic focus voltage.

Moreover, the second focus voltage Ef2 to be applied to the (5-2)th electrode 52 is supplied to the (3-1)th electrode 13A.

Furthermore, in this embodiment, the (3-2)th electrode 13B and both outside (5-1A)th electrode 51A and (5-1C)th electrode 51C of the thrice-divided (5-1)th electrode 51 are connected in common, and the electrodes 13, 51A, and 51C connected in common are electrically connected to the (5-1B)th electrode 51B through the built-in resistor 27.

The first focus voltage Ef1 in which the third focus voltage Ef3 receives an action of a low-pass filter through the built-in resistor 27 is applied to the electrodes 13B, 51A, and 51C as a static focus voltage.

In this case, the first focus voltage Ef1 becomes a waveform voltage in which the third focus voltage Ef3 decreases in amplitude in accordance with the action of the low-pass filter of the built-in resistor 27.

Moreover, an independent quadrupole lens IQL is constituted by the (5-1)th electrodes 51A, 51B, and 51C, and a lens action is generated by the first focus voltage Ef1 and the third focus voltage Ef3.

Furthermore, a second dynamic quadrupole lens DQL2 is constituted by the (5-1)th electrode 51C and the (5-2)th electrode 52 and a lens action is generated by the first focus voltage Ef1 and the second focus voltage Ef2.

Furthermore, the quadrupole lens action of the second dynamic quadrupole lens DQL2 is controlled by the independent quadrupole lens IQL.

The built-in resistor 27 uses, for example, a thick-film resistor having a resistance value of tens to thousands of MΩ though depending on a frequency band in which a color cathode is used.

According to the above configuration, it is possible to divide an externally supplied focus voltage into the second focus voltage Ef2 and the third focus voltage Ef3.

Moreover, in the color-cathode-ray-tube electron gun 10 of this embodiment, the (5-1)th electrode, that is, the (5-1A) th electrode 51A, the (5-1B)th electrode 51B, and the (5-1C)th electrode 51C respectively employ shapes capable of independently controlling three electron beams R, G, and B like the previously- proposed and described color-cathode-ray-tube electron gun.

FIGS. 7 to 10 show forms of electron-beam passing bores of the (5-1)th electrodes 51A, 51B, and 51C and the (5-2)th electrodes 52.

Figure 7:
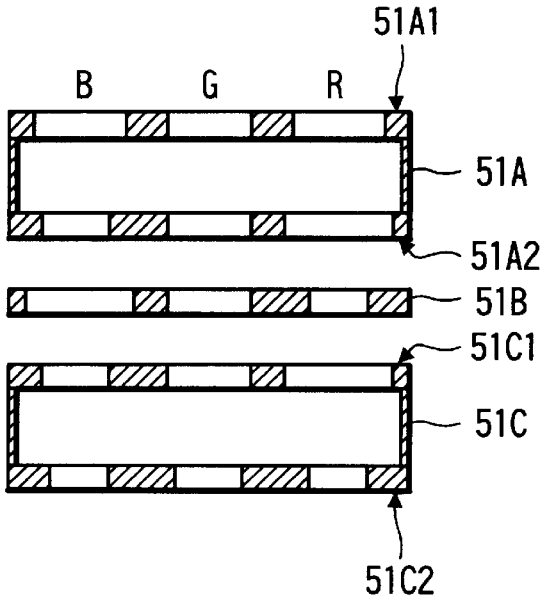
FIG. 7 is a sectional view showing a first configuration of a shape of the (5-1)th electrode of the electron gun in FIG. 6.
Figure 8A:
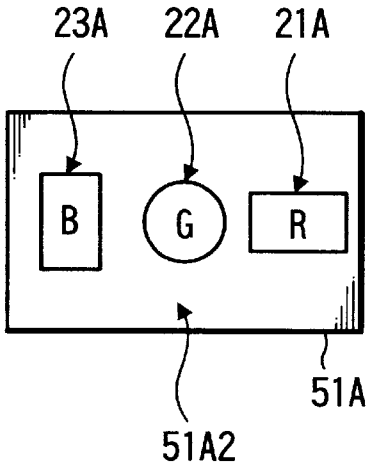
FIG. 8 consisting of FIGS. 8A through 8C, is diagrams showing first configurations of the shape of the (5-1)th electrode of the electron gun in FIG. 6.
Figure 8B:
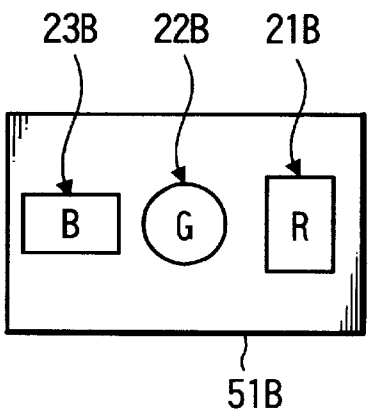
Figure 8C:
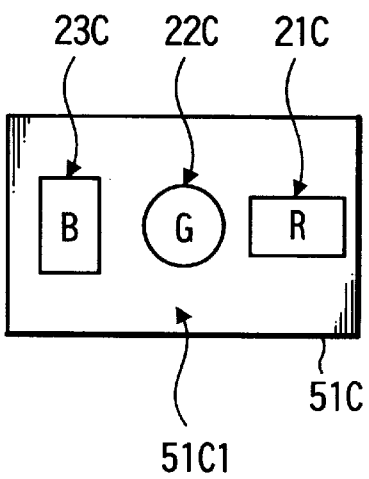

FIG. 7 shows sectional views of the (5-1)th electrode (51A, 51B, and 51C) horizontally cut, and FIG. 8 shows schematic views of shapes of electron-beam passing bores on opposing planes of the thrice-divided (5-1)th electrodes 51A, 51B, and 51C.

Figure 9:
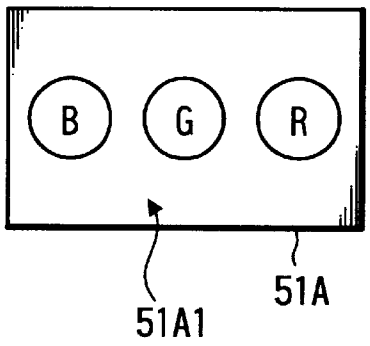
FIG. 9 is a schematic view of a shape of an electron-beam passing bore on the cathode-side plane of the (5-1A)th electrode of the electron gun in FIG. 6.
Figure 10:
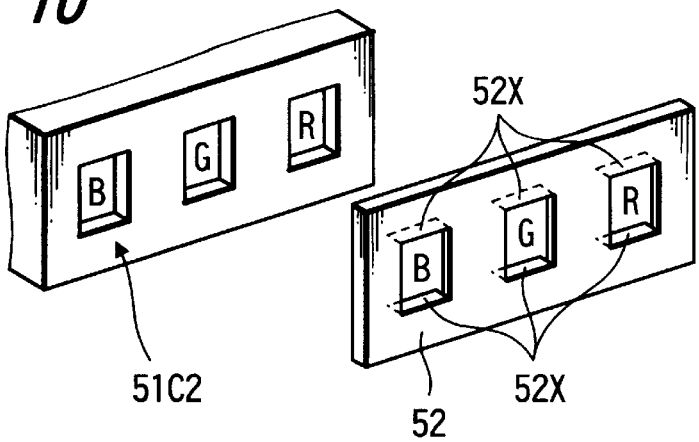
FIG. 10 is a diagram showing schematic views of the anode-side plane of the (5-1C)th electrode and the shape of electron-beam passing bores of the (5-2)th electrode of the electron gun in FIG. 6.

FIG. 9 shows a schematic view of electron-beam passing bores of a plane 51A1 on the cathode-K side of the (5-1A)th electrode, and FIG. 10 shows schematic views of a plane 51C2 on the anode side of the (5-1C)th electrode and shapes of electron-beam passing bores of the (5-2)th electrode.

As shown in FIGS. 7 and 8, in opposing planes of the (5-1)th electrodes 51A, 51B, and 51C, that is, the anode-side plane 51A2 of the (5-1A)th electrode 51A, both planes of the (5-1B)th electrode 51B, and the plane 51C1 of the (5-1C)th electrode 51C on the cathode-K side, electron-passing bores 21A, 21B, and 21C (through which the electron beam R passes in this configuration) provided on one end side, respectively, are of an astigmatic shape different from electron-beam passing bores 23A, 23B, and 23C (through which the electron beam B passes in this configuration) provided on the other end side, that is, of a vertically-long or horizontally-long shape.

Moreover, electron-beam passing bores provided on both end sides of the (5-1)th electrodes 51A, 51B, and 51C, respectively, are of an astigmatic shape different from the electron-beam passing bores provided on the plane of the opposing (5-1)th electrode. specifically, astigmatic shapes of the electron-beam passing bores 21A and 23A provided on both end sides of the (5-1A)th electrode 51A are different from those of the electron-beam passing bores 21B and 23B provided on both sides of the opposing (5-1B)th electrode 51B. Astigmatic shapes of the electron-beam passing bores 21B and 23B provided on both end sides of the (5-1B)th electrode 51B are different from those of the electron-beam passing bores 21C and 23C provided on both end sides of the opposing (5-1C)th electrode 51C.

That is, the electron-beam passing bores 21A and 21C (through which the electron beam R passes in this configuration) provided on one end side of both outside (5-1A)th electrode 51A and (5-1C)th electrode 51C, respectively, are of a horizontally-long astigmatic shape, the electron-beam passing bores 22A and 22C (through which the electron beam G passes in this configuration) provided at the middle between electrodes 51A and 51C respectively are of a circular shape, and the electron-beam passing bores 23A and 23C (through which the electron beam G passes in this configuration) provided on the other end sides of the electrodes 51A and 51C, respectively, are of a vertically-long astigmatic shape. Meanwhile, the electron-beam passing bore 21B (through which the electron beam R passes in the case of this embodiment) provided on one end side of the central (5-1B)th electrode 51B is of a vertically-long astigmatic shape, the electron-beam passing bore 22B (through which the electron beam G passes in this configuration) provided at the center of the electrode 51B is of a circular shape, and the electron-beam passing bore 23B (through which the electron beam B passes in this configuration) provided on the other end side of the electrode 51B is of a horizontally-long astigmatic shape.

In this case, when the red electron beam R passing through comparatively outside of a deflection magnetic field on the right side of a screen passes through horizontally-long, vertically-long, and horizontally-long astigmatic electron-beam passing bores, a convergent-lens effect occurs in the quadrupole lens of the divided (5-1)th electrode 51 on the right side of a screen and the convergent-lens effect having been acting so far is strengthened.

On the contrary, when the blue electron beam B passing through comparatively inside of a deflection magnetic field on the right side of a screen passes through vertically-long, horizontally-long, and vertically-long astigmatic electron-beam passing bores, a diverging lens effect occurs in the quadrupole lens of the divided (5-1)th electrode 51 on the right side of a screen and the convergent-lens effect having been acting so far is weakened.

Thereby, it is possible to improve spot shapes of the red(R) and blue(B) electron beams.

Figure 4:
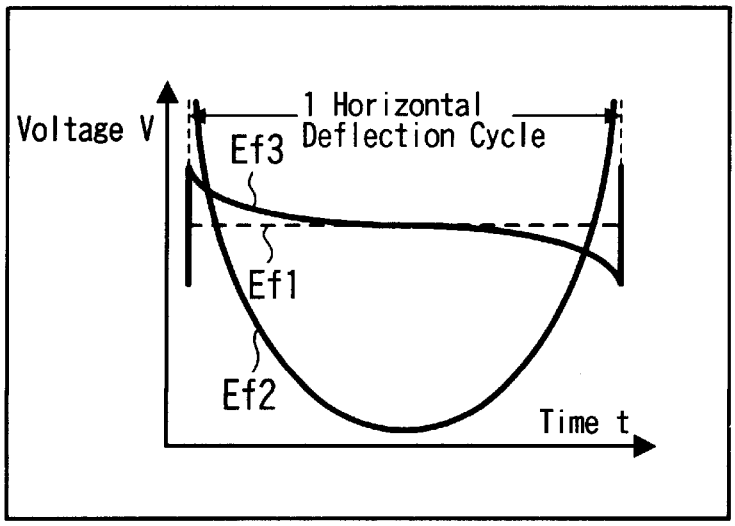
FIG. 4 is a diagram showing a waveform of a focus voltage to be applied to the electron gun in FIG. 3.
Figure 5B:
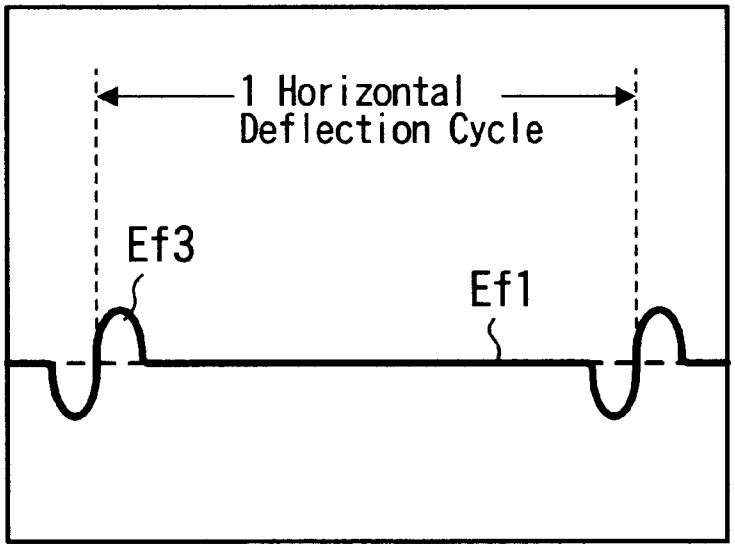
FIGS. 5A and 5B are diagrams showing still other waveform voltages to be applied to the electron gun in FIG. 3.
Figure 5A:
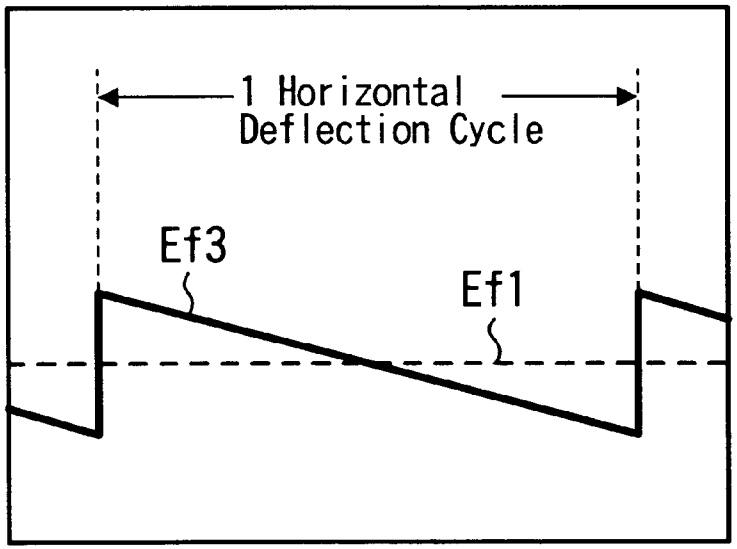

By forming the passing bores of the three electron beams R, G, and B of the (5-1)th electrodes 51A, 51B, and 51C and applying a waveform voltage synchronizing with horizontal scanning to these electrodes, as in the case shown in FIG. 4, it is possible to cancel an electron-beam convergent action due to a deflection magnetic field received by both outside electron beams R and B and form the three electron beams R, G, and B into the same preferable shapes.

As shown in FIG. 9, on the plane 51A1 on the anode side of the (5-1A)th electrode 51A, passing bores of three electron beams R, G, and B are formed into circular shapes having the same dimension vertically-long astigmatic shapes having the same dimension.

As shown in FIG. 10, on the (5-2)th electrode 52 on the anode side of the (5-1C)th electrode 51C, passing bores of three electron beams R, G, and B are formed into vertically-long astigmatic shapes having the same dimension. Moreover, as shown in FIG. 10, on the (5-2)th electrode 52 facing the plane 51C2, passing bores of three electron beams R, G, and B are formed into vertically-long astigmatic shapes having the same dimension and screen-like top and bottom protrusions 52X.

Then, the influences of crosstalk in the electron gun 10 having the above electrode configuration are described below.

Figure 21:
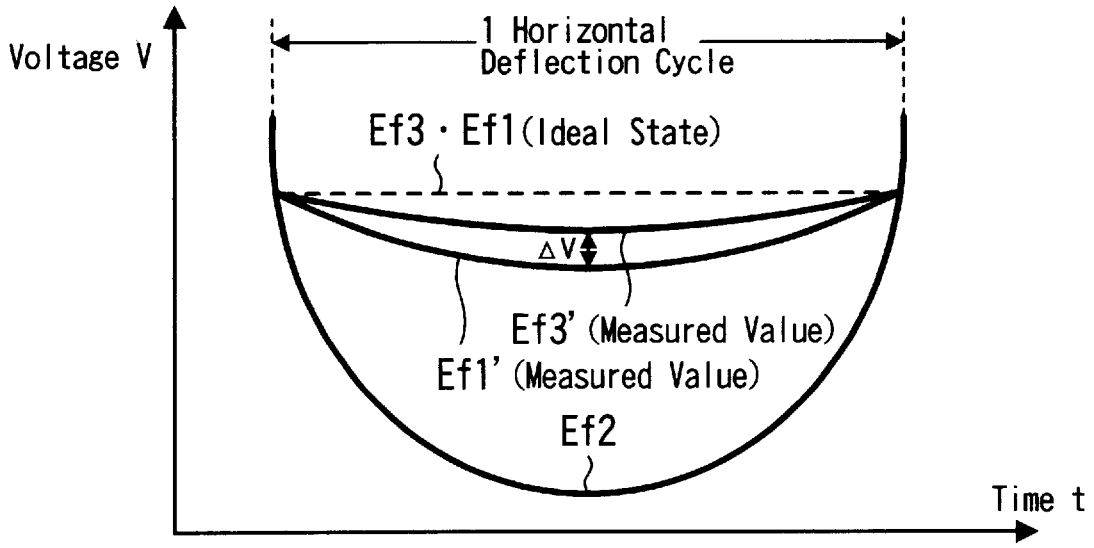
FIG. 21 is a diagram for explaining the influences of crosstalk on a voltage waveform of a focus voltage.

First, to simplify the description, FIG. 21 shows each focus-voltage waveform when the amplitude of the third focus voltage Ef3 serving as a dynamic focus voltage is equal to 0, that is, the focus voltage Ef3 is a fixed voltage.

Under an ideal state in which the crosstalk between electrodes is not taken into consideration, the third focus voltage Ef3 and the first focus voltage Ef1 completely serve as fixed focus voltages, respectively.

However, because the second focus voltage Ef2 has a parabolic waveform (so-called parabola shape) having an amplitude of approx. 500 V, crosstalk occurs between the (5-2)th electrode 52 to which the second focus voltage Ef2 is applied and the (5-1C)th electrode 51C to which the first focus voltage Ef1 is applied.

Thereby, a measured value Ef1' of the first focus voltage Ef1 shows a parabolic waveform having an amplitude smaller than that of the second focus voltage Ef2.

Moreover, though the actual third focus voltage Ef3 is smaller than the first focus voltage Ef1, it is influenced by crosstalk. Therefore, a measured value Ef3' of the third focus voltage Ef3 also shows a parabolic waveform having an amplitude smaller than that of the first focus voltage Ef1.

Therefore, as shown in FIG. 21, the difference between the first focus voltage Ef1 and the third focus voltage Ef3 matches a fixed focus voltage under an ideal state. However, a potential difference ΔV occurs between the measured values Ef1' and Ef3'.

Moreover, in the case of the electron gun 10 having the above configuration, when considering a spot size at corner portions (vicinity of four corners), the gun 10 is frequently constituted so that the difference between the first focus voltage Ef1 and the second focus voltage Ef2 decreases or the focus voltages Ef1 and Ef2 are almost equal to each other. In this case, the gun 10 is frequently constituted so that the difference between the first focus voltage Ef1 and the second focus voltage Ef2 is increased and the first focus voltage Ef1 becomes equal to the third focus voltage Ef3 at the center and Y-axis ends of a screen.

However, when the gun 10 is constituted as described above, if crosstalk occurs between the electrodes, Ef1 becomes smaller than Ef3 at the center and the Y-axis ends of a screen, similarly to an occurrence of the potential difference ΔV, and thus a potential difference occurs between Ef1 and Ef3.

The potential difference causes a quadrupole-lens action in the independent quadrupole lens IQL constituted by the (5-1)th electrodes 51A, 51B, and 51C.

That is, quadrupole-lens actions which are to be originally generated to R, G, and B at only right and left ends of a screen also occur at the center and Y-axis ends of the screen.

Thereby, either or both of the R and B electron beams causes or cause deterioration of a spot shape at the center and Y-axis ends of the screen.

Several methods for solving the above phenomenon, that is, the deterioration of a spot shape due to the potential difference between Ef1 and Ef3 are considered, as described below.

First, a first solving method is a method of adjusting a focus voltage supply circuit or a capacity between electrodes and thereby decreasing the crosstalk between the (5-2)the electrode 52 to which the second focus voltage Ef2 is applied and the (5-1C)th electrode 51C to which the first focus voltage Ef1 is applied.

For example, by decreasing the amplitude of the second focus voltage Ef2, crosstalk decreases.

Moreover, by making the distance farther between electrodes and thereby, decreasing the capacity between the electrodes, crosstalk decreases.

Furthermore, a second solving method is a method of decreasing the lens sensitivity of the independent quadrupole lens IQL by decreasing the differences between major-side lengths and minor-side lengths of electron-beam passing bores of the (5-1A)th electrode 51A, (5-1B)th electrode 51B, and (5-1C)th electrode 51C, that is, astigmatic degrees.

In this case, to compensate for deterioration of the lens sensitivity of the independent quadrupole lens IQL, the amplitude of the third focus voltage Ef3 to be applied to the lens is increased.

Moreover, a third solving method is a method of improving the waveform of the first focus voltage Ef1 and making the potential difference between the (5-1C)th electrode 51C and the (5-2)th electrode 52 approach to 0.

The present invention realizes the third method.

According to the third method, the waveform of the first focus voltage Ef1 has only to be changed without changing the sensitivity of the independent quadrupole lens IQL, interval between electrodes, or the amplitude of the second focus voltage Ef2. Therefore, an advantage is obtained that a design change of an electron gun is comparatively small.

Moreover, particularly in this embodiment, a voltage waveform of the third focus voltage Ef3 is improved in order to generate the first focus voltage Ef1 for making the potential difference between the (5-1C)th electrode 51C and the (5-2)th electrode 52 approach to 0.

Figure 11:
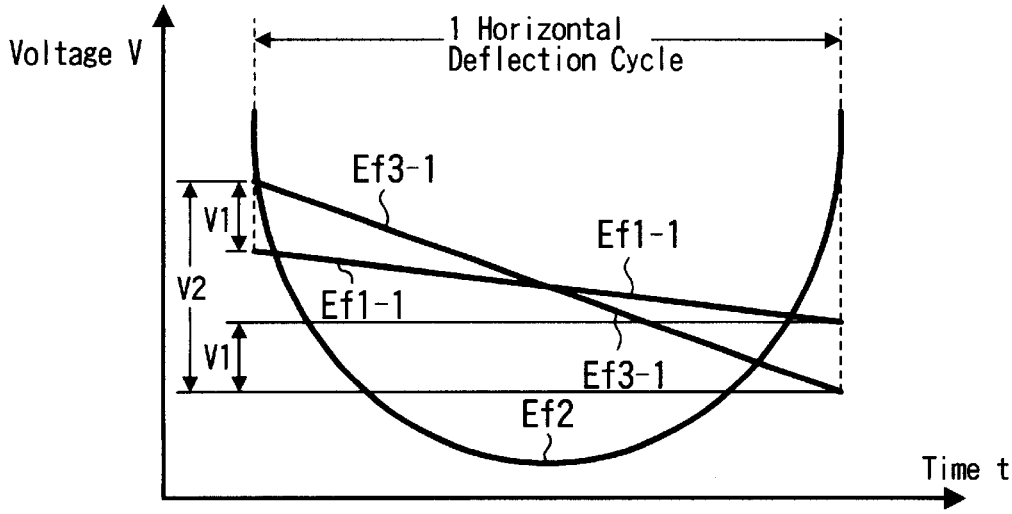
FIG. 11 is a diagram showing a configuration of the waveform of a focus voltage used for the electron gun in FIG. 6.
Figure 12:
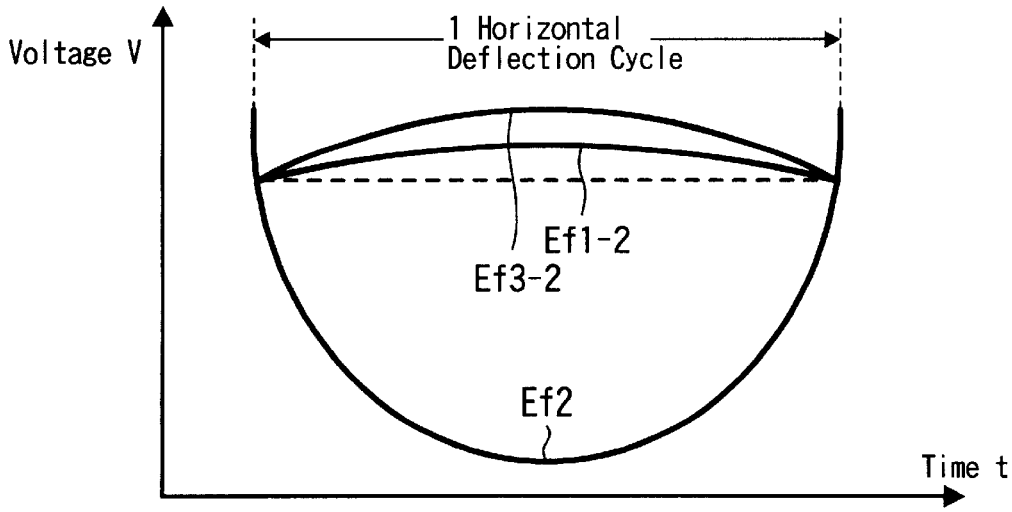
FIG. 12 is a diagram showing a configuration of the waveform of a focus voltage used for the electron gun in FIG. 6.
Figure 13:
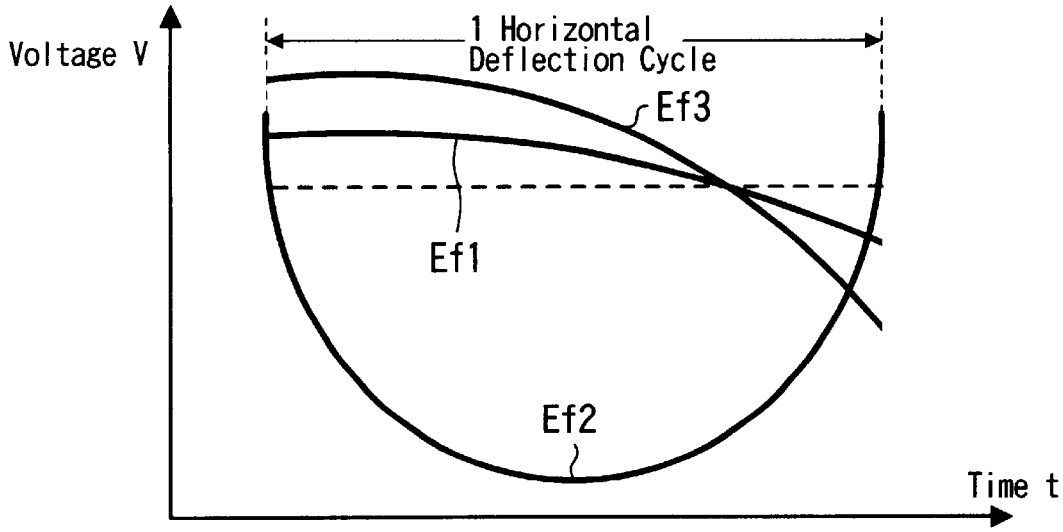
FIG. 13 is a diagram showing a configuration of the waveform of a focus voltage used for the electron gun in FIG. 6.

FIGS. 11 to 13 show a configuration of each of the focus voltage waveforms Ef1, Ef2, and Ef3 to be applied to the electron gun 10 in this embodiment. The voltage waveform in FIG. 13 is a final focus voltage obtained from the voltage waveform in FIG. 11 and the waveform in FIG. 12.

In the case of this embodiment, the third focus voltage Ef3 is used as a waveform voltage on which a first voltage component, that is, a waveform voltage Ef3-1 having a shape similar to serration synchronizing with horizontal scanning shown in FIG. 11 and a second voltage component, that is, a waveform voltage Ef3-2 having a parabolic shape (so-called parabola shape) convex in the direction opposite to the parabolic shape of the waveform of the second focus voltage Ef2 shown in FIG. 12 are superimposed.

The first voltage component Ef3-1 and second voltage component Ef3-2 are superimposed and, thereby, the third focus voltage Ef3 having the voltage waveform shown in FIG. 13 is obtained.

Then, the first focus voltage Ef1 becomes a waveform voltage obtained by decreasing the amplitude of the third focus voltage Ef3 in accordance with the effect of the low-pass filter of the built-in resistor 27, as described above.

Therefore, according to this embodiment, the first focus voltage Ef1 also becomes a voltage on which a first voltage component the same as the third focus voltage EF3, that is, a waveform voltage Ef1-1 having a shape similar to serration synchronizing with horizontal scanning shown in FIG. 11 and a second voltage component, that is, a waveform voltage Ef1-2 having a parabolic waveform convex in the direction opposite to the parabolic shape of the waveform of the second focus voltage Ef2 shown in FIG. 12, are superimposed.

The first voltage component Ef1-2 and second voltage component Ef1-2 are superimposed, and the first focus voltage Ef1 having the voltage waveform shown in FIG. 13 is obtained.

The second voltage components Ef1-2 and Ef3-2 shown in FIG. 12 have an action for canceling a potential difference ΔV due to the crosstalk shown by measured values Ef1' and Ef3' in FIG. 21.

Therefore, by applying a waveform on which the second voltage component shown in FIG. 12 is superimposed, that is, the voltage waveform shown in FIG. 13 to the first voltage components Ef1-1 and Ef3-1 shown in FIG. 11, a measured value to which influences of crosstalk are added shows a voltage waveform reflecting the first voltage components Ef1-1 and Ef3-1.

Thereby, a potential difference V1 between Ef1 and Ef3 at right and left ends of the screen shown in FIG. 11 is set to a value close to 30 V, and an amplitude V2 of Ef3 is set to a value closed to 100 V.

Moreover, no potential difference occurs between Ef1 and Ef3 at the center and Y-axis ends of the screen.

That is, a lens is formed on the (5-1)th electrode 51 at the right and left ends of the screen because the potential difference V1 is generated between the first focus voltage Ef1 and the third focus voltage Ef3. However, because no potential difference is generated between the first focus voltage Ef1 and third focus voltage Ef3 at the center and Y-axis ends of the screen, no lens is formed on the (5-1)th electrode 51.

In this case, as for the amplitude of the waveform of each focus voltage, for example, the first focus voltage Ef1 has approximately 40 V, the second focus voltage Ef2 has approximately 500 V, and the third focus voltage Ef3 has approximately 100 V (=V2).

Figure 14:
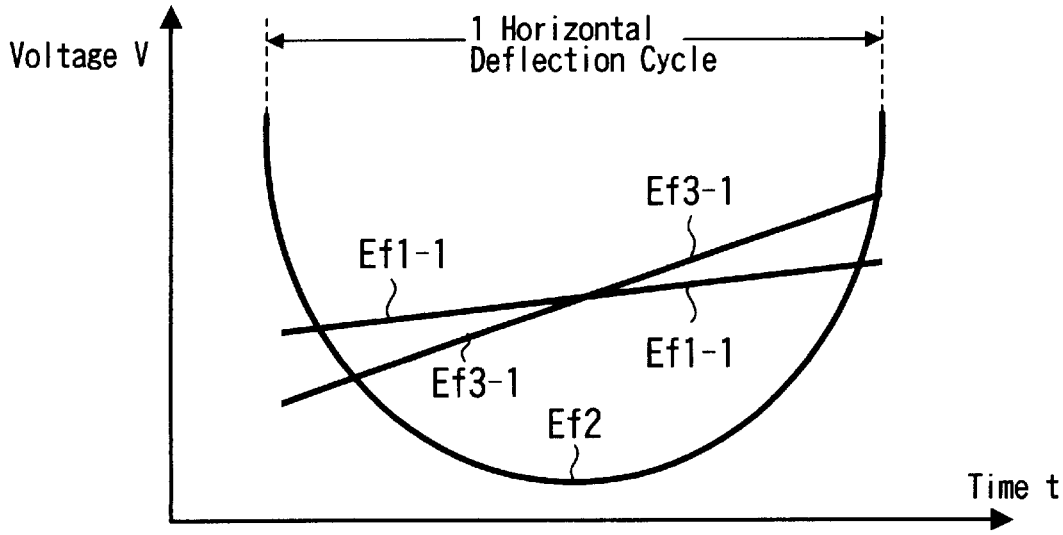
FIG. 14 is a diagram showing another configuration of the waveform of a focus voltage used for the electron gun in FIG. 6.

The polarities of the first voltage components Ef1-1 and Ef3-1 serving as waveform voltages having shapes similar to serration to be superimposed may use a waveform obtained by inverting the waveform in FIG. 11, as shown in FIG. 14, depending on the specification of a deflection yoke.

Figure 15:
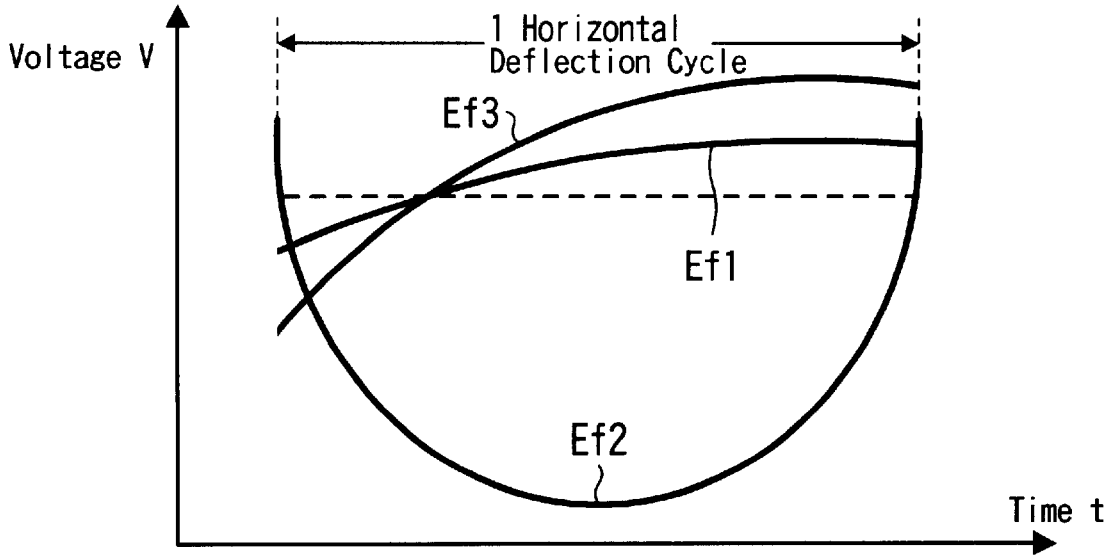
FIG. 15 is a diagram showing still another configuration of the waveform of a focus voltage used for the electron gun in FIG. 6.

When the waveform in FIG. 14 is superimposed as the first voltage component, the waveforms of voltage of the first focus voltage Ef1 and third focus voltage Ef3 are formed into the waveform shown in FIG. 15.

Moreover, instead of inverting a waveform, it also is permitted to form shapes of electron-beam passing bores of the (5-1)th electrodes 51A, 51B, and 51C into inverse astigmatic shapes or generate an inverse lens effect by replacing the passing bore of the blue(B) electron beam with that of the red(R) electron beam.

Figure 16:
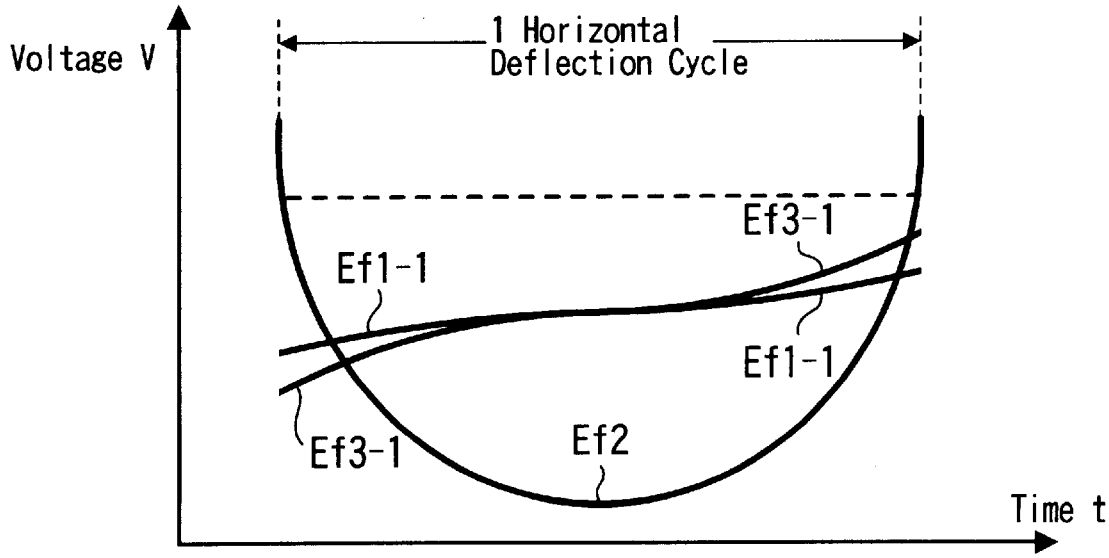
FIG. 16 is a diagram showing still another configuration of the waveform of a focus voltage used for the electron gun in FIG. 6.

Furthermore, it is permitted to superimpose a waveform voltage having a shape similar to serration according to the curve in FIG. 16 as the first voltage components Ef3-1 and Ef1-1 instead of the waveform voltage having a shape similar to serration according to the straight line shown in FIG. 11.

According to the above embodiment, because a focus voltage supplied from an external unit can be supplied through two lines, such as a line of the second focus voltage Ef2 and a line of the third focus voltage Ef3, the number of types of focus voltages to be adjusted is decreased compared to a case of supplying focus voltages through three lines.

Therefore, it is possible to reduce the time for adjusting a focus voltage.

Moreover, three electron beams are formed into preferable shapes at the same time by increasing the potential difference between the first focus voltage Ef1 and the third focus voltage Ef3 at the right and left ends of a screen while eliminating the potential difference at the center and Y-axis ends of the screen.

A method of using a built-in resistor as a low-pass filter is disclosed in, for example, U.S. Pat. No. 2,645,061. However, the method is used only to unite two types of focus voltages, that is, a parabolic-waveform voltage and a fixed focus voltage, into one voltage in a configuration having a dynamic quadrupole electrode and a focus electrode but three electron beams are not formed into preferable shapes like the case of the present invention.

In this case, according to the above embodiment, dynamic quadrupole electrodes formed between the (5-1C)th electrode 51C, the (5-2)th electrode 52, and the sixth electrode 16 and the effect of a focus become asymmetric at the right and left of a screen. However, because the potential difference between the first focus voltage Ef1 and second focus voltage Ef2 serving as a factor of the asymmetry is small, it is possible to completely ignore the potential difference.

Then, other configurations such as the shapes of electron-beam passing bores of the thrice-divided (5-1)th electrode 51, are described below.

First Configuration

As shown in FIGS. 7 and 8, in the case of the first configuration, the difference between convergent actions of electron beams due to a deflection magnetic field received by both outside electron beams R and B is canceled by forming both outside electron-beam passing bores of the (5-1)th electrode 51 into vertically- and horizontally-long astigmatic shapes to form three electron beams R, G, and B into the same preferable shape.

The same action can be obtained by forming both outside electron-beam passing bores of the (5-1)th electrode 51 into other shapes as shown in second and third embodiments mentioned later.

Second Configuration

Figure 17A:
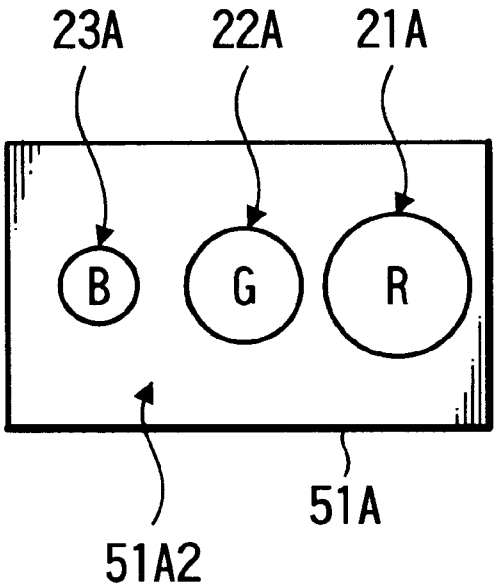
FIGS. 17A, 17B, and 17C are diagrams showing second configurations of the shape of the (5-1)th electrode of the electron gun in FIG. 6.
Figure 17B:
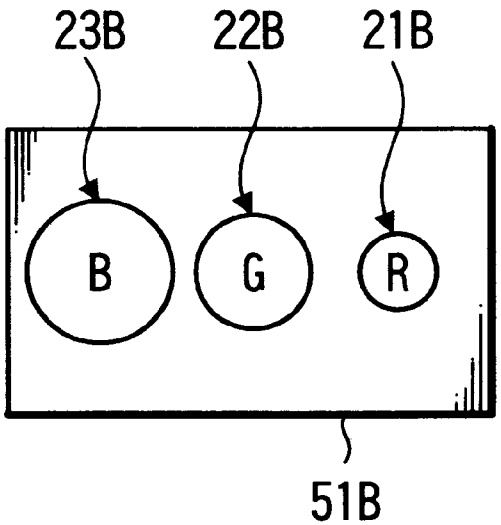
Figure 17C:
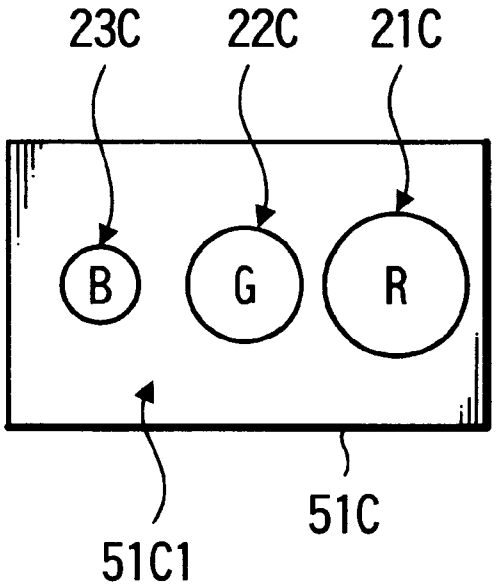
Figure 18B:
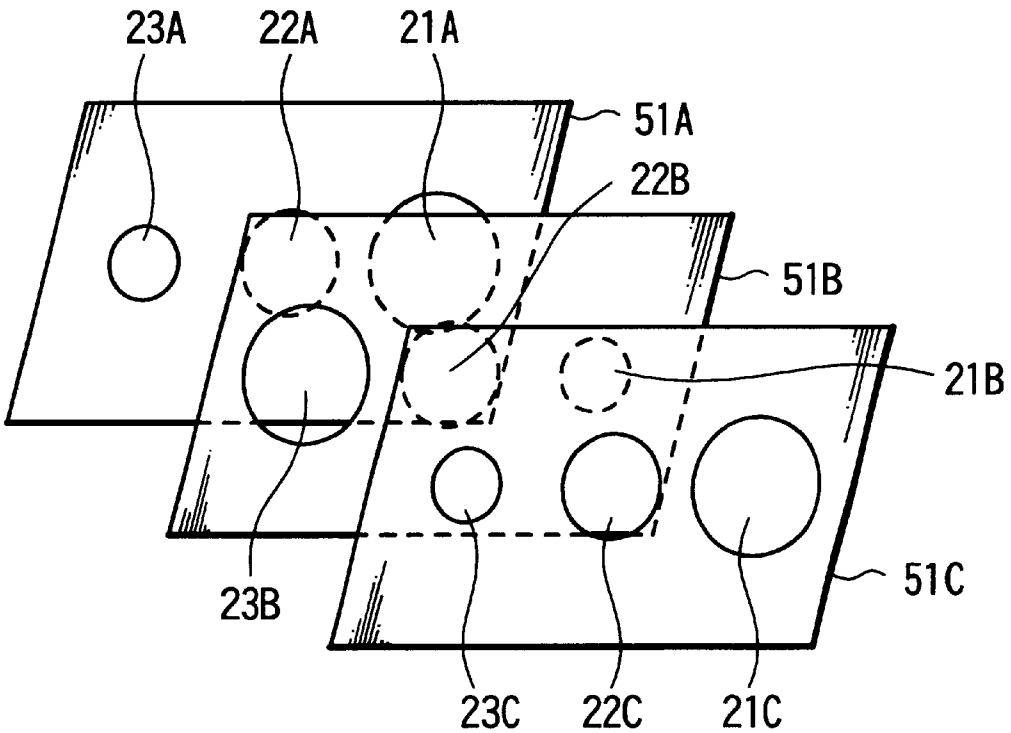
FIGS. 18A and 18B are diagrams showing positional relations of the (5-1)th electrode for the configurations in FIG. 17A, 17B and 17C.
Figure 18A:
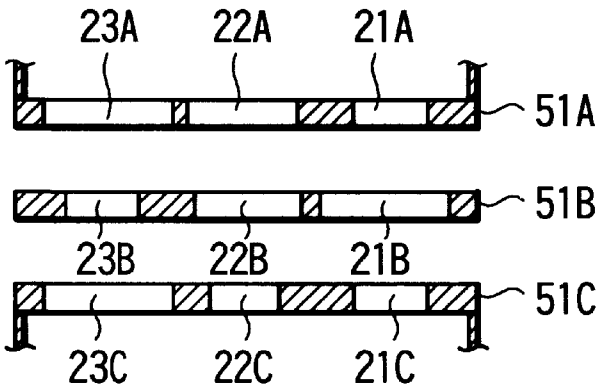

First, as a second configuration, FIGS. 17A, 17B, and 17C show schematic views of electron-beam passing bores of the thrice-divided (5-1)th electrode 51 (51A, 51B, and 51C); FIG. 18A shows a sectional view of the thrice-divided (5-1)th electrode 51 when horizontally cutting the electrode 51; and FIG. 18B shows a schematic perspective view of an arrangement state of passing bores corresponding to three electron beams.

As shown in FIGS. 17A, 17B, 17C, 18A and 18B on opposing planes of the (5-1)th electrodes 51A, 51B and 51C, that is, on the anode-side plane 51A2 of the (5-1A)th electrode 51A, both planes of the (5-1B)th electrode 51B, and the cathode-K-side plane 51C1 of the (5-1C)th electrode 51C, the electron-beam passing bores 21A, 21B, and 21C provided on one end side (through which the electron beam R passes in this configuration) are opposite in diameter to the electron-beam passing bores 23A, 23B, and 23C (through which the electron beam B passes in this configuration).

Moreover, electron-beam passing bores formed at the both ends of the (5-1)th electrodes 51A, 51B, and 51C are opposite to the electron-beam passing bores formed on the plane of the opposing (5-1)th electrode in diameter, that is, the former is larger than the latter.

Specifically, the electron-beam passing bores 21A and 23A formed at the both ends of the (5-1A)th electrode 51A are different in diameter from the electron-beam passing bores 21B and 23B formed at both ends of the opposing (5-1B)th electrode 51B and the electron-beam passing bores 21B and 23B formed at both ends of the (5-1B)th electrode 51B are different in diameter from the electron-beam passing bores 21C and 23C formed at both ends of the opposing (5-1C)th electrode 51.

That is, the electron-beam passing bores 21A and 21C (through which the electron beam R passes in this configuration) formed at one end of both the outside (5-1A) th electrode 51A and the (5-1C)th electrode 51C, respectively, have a large diameter, the electron-beam passing bores 22A and 22C (through which the electron beam C passes in this configuration) formed at the middle between the electrodes 51A and 51C, respectively, have an intermediate diameter, and the electron-beam passing bores 23A and 23C formed at the other ends of the electrodes 51A and 51C, respectively, have a small diameter. The electron-beam passing bore 21B (through which the electron beam B passes in this configuration) formed at one end of the central (5-1B)th electrode 51B has a small diameter, the electron-beam passing bore 22B (through which the electron beam G passes in this configuration) formed at the center of the electrode 51B has an intermediate diameter, and the electron-beam passing bore 23B (through which the electron beam B passes in this configuration) formed at the other end of the electrode 51B has a large diameter.

Thereby, in the cases of FIGS. 1A, 17B, 17C, 18A and 18B, when the red electron beam R passing through comparatively outside of a deflection magnetic field on the right side of a screen passes through large-, small-, and large-diameter electron-beam passing bores, a convergent-lens effect occurs in the focus lens of the divided (5-1)th electrode 51 on the right side of the screen and thus, a conventionally-acting convergent-lens effect is strengthened.

However, when the blue electron beam B passing through comparatively inside of a deflection magnetic field at the right side of the screen passes through large-, small-, and large-diameter electron-beam passing bores, a divergent-lens effect occurs in the focus lens of the divided (5-1)th electrode 51 on the right side of the screen, and the conventionally-acting lens effect is weakened.

By forming passing bores of three electron beams R, G, and B of the (5-1)th electrodes 51A, 51B, and 51C, as described above, and applying the waveform shown in FIG. 13 or FIG. 15 to the electrodes 51A, 51B, and 5C as the focus voltages Ef1, Ef2, and Ef3, the difference between electron-beam convergent actions due to a deflection magnetic field received by both the outside electron beams R and B is canceled and the three electron beams R, G, and B can be formed into the same preferable shape.

Third Configuration

Figure 19A:
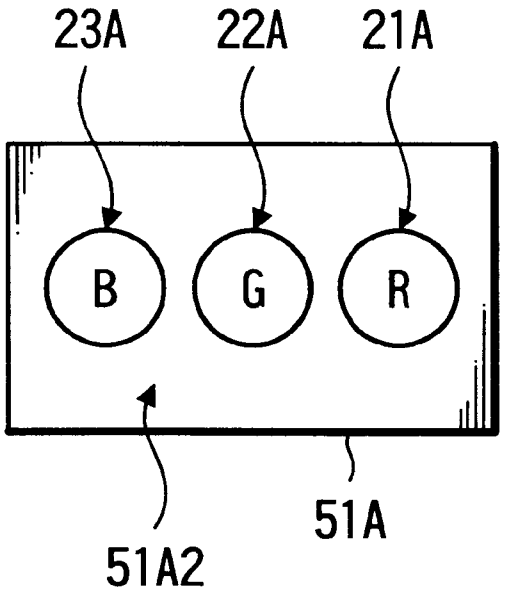
FIGS. 19A, 19B and 19C are diagrams showing third configurations of the shape of the (5-1)th electrode of the electron gun in FIG. 6.
Figure 19B:
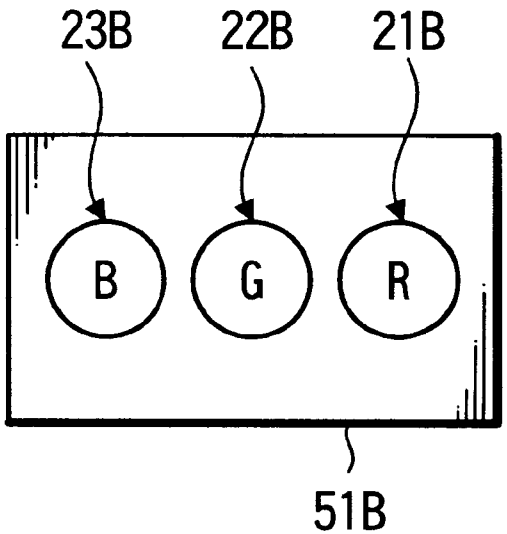
Figure 19C:
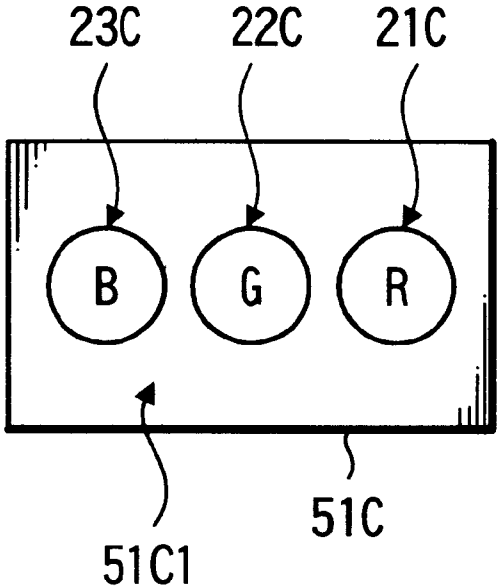
Figure 20B:
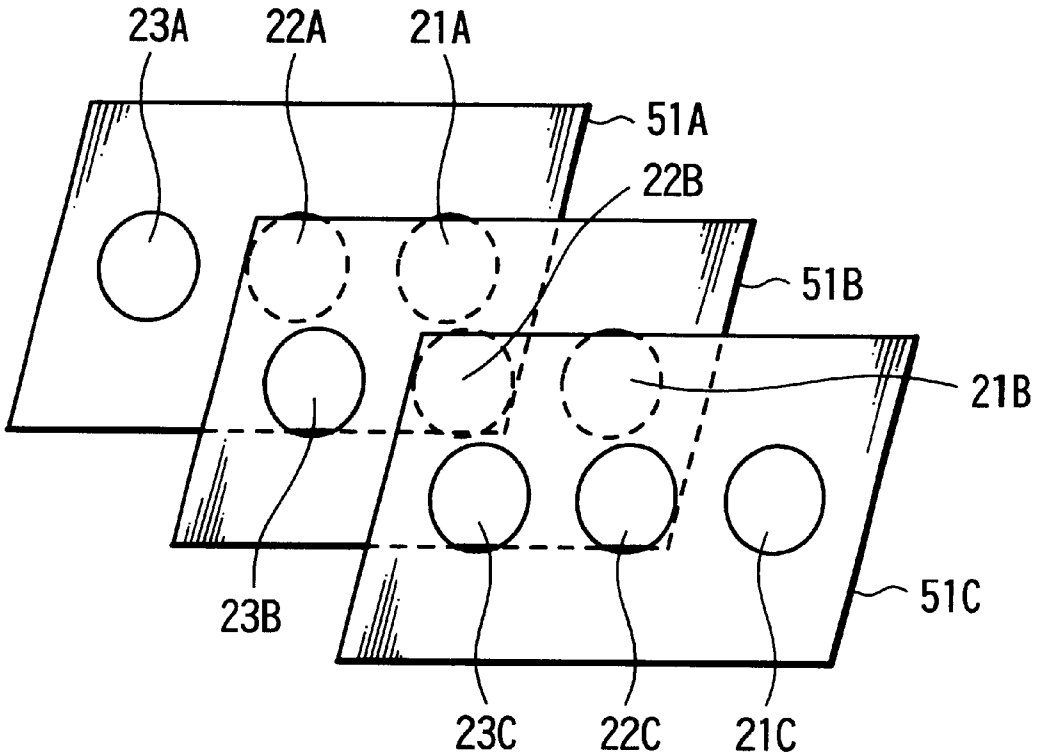
FIGS. 20A and 20B are diagrams showing positional relations of the (5-1)th electrode for the configurations in FIG. 19.
Figure 20A:
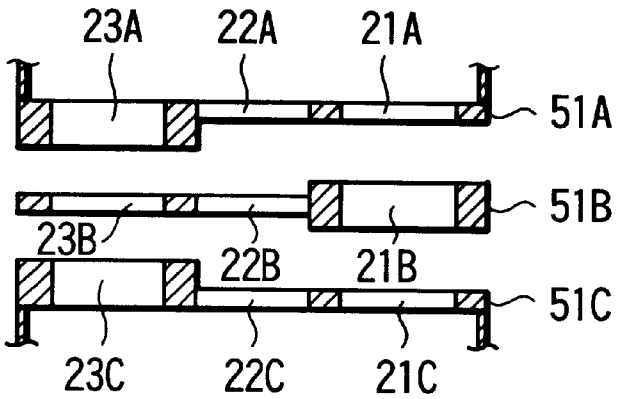

Then, as a third configuration, FIGS. 19A, 19B, and 19C show schematic views of shapes of electron-beam passing bores of the focus electrodes 51A, 51B, and 51C, FIG. 20A shows a sectional view of the thrice-divided (5-1)th electrode (51A, 51B, and 51C) when cutting the (5-1)th electrode on a horizontal plane; and FIG. 20B shows a schematic perspective view of an arrangement state of passing bores corresponding to three electron beams.

As shown in FIGS. 19A, 19B, and 19C, electron-beam passing bores are formed into circular shapes having the same diameter.

Moreover, as shown in FIGS. 20A and 20B, on the opposing planes of the (5-1)th electrodes 51A, 51B, and 51C, that is, the anode-side plane 51A2 of the (5-1A)th electrode 51A, both planes of the (5-1B)th electrode 51B, and the cathode-K-side plane 51C1 of the (5-1C)th electrode 51C, the electron-beam passing bores 21A, 21B, and 21C (through which the electron beam R passes in this configuration) provided on one end side are different in plate thickness of electrodes around the electron-beam passing bores from the electron-beam passing bores 23A, 23B, and 23C provided on the other end side.

Moreover, the periphery of the electron-beam passing bores formed at the both ends of the (5-1)th electrodes 51A, 51B, and 51C is different from the periphery of the electron-beam passing bores provided on the plane of the opposing (5-1)th electrode in plate thickness.

Specifically, the periphery of the electron-beam passing bores 21A and 23A formed at both ends of the (5-1A)th electrode 51A is different in plate thickness from the periphery of the electron-beam passing bores 21B and 23B provided on the both sides of the opposing (5-1B)th electrode 51B, and the periphery of the electron-beam passing bores 21B and 23B provided at both ends of the (5-1B)th electrode 51B is different in plate thickness from the periphery of the electron-beam passing bores 21C and 23C provided at the both ends of the opposing (5-1C)th electrode 51C.

That is, the periphery of the electron-beam passing bores 21A and 21C (through which the electron beam R passes in this configuration) provided at one end of both the outside (5-1A)th electrode 51A and the (5-1C)th electrode 51C has a small plate thickness, the periphery of the electron-beam passing bores 22A and 22C (through which the electron beam G passes in this configuration) provided at the middle between the electrodes 51A and 51C has a small plate thickness, and the periphery of the electron-beam passing bores 23A and 23C (through which the electron beam B passes in this configuration) formed at the other ends of the electrodes 51A and 51C has a large plate thickness. Moreover, the periphery of the electron-beam passing bore 21B (through which the electron beam R passes in this configuration) provided at one end of the central (5-1B)th electrode 51B has a large plate thickness, the periphery of the electron-beam passing bore 22B (through which the electron beam G passes in this configuration) provided at the center of the electrode 51B has a small plate thickness, and the electron-beam passing bore 23B (through which the electron beam B passes in this configuration) provided at the other end of the electrode 51B has a small plate thickness.

In the cases of FIGS. 19A, 19B, 19C, 20A and 20B, the red electron beam R passing through comparatively outside of a deflection magnetic field on the right side of a screen passes through small-, large-, and small-plate-thickness electron-beam passing bores and, thus, a convergent-lens effect occurs in the focus lens of the divided (5-1)th electrode 51 on the right side of the screen, and a conventionally-acting convergent lens effect is strengthened.

However, the blue electron beam B passing through comparatively inside of a deflection magnetic field on the right side of a screen passes through large-, small-, and large-plate-thickness electron-beam passing bores and, thus, a diverging-lens effect occurs in the focus lens of the divided (5-1)th electrode 51 on the right side of the screen, and a conventionally-acting convergent lens effect is weakened.

By constituting passing bores of three electron beams R, G, and B of the (5-1)th electrodes 51A, 51B, and 51C, as described above, and applying the waveform voltage shown in FIG. 13 or 15 as the focus voltages Ef1, Ef2, and Ef3, it is possible to cancel the difference between electron-beam convergence action due to a deflection magnetic field received by both outside electron beams R and B and form the three electron beams R, G, and B into the same preferable shape as in the case of the first configuration.

In the case of the above embodiments, a focus electrode is constituted by the thrice-divided (5-1)th electrode 51 (51A, 51B, and 51C) and the (5-2)th electrode 52. Moreover, the present invention can use a focus electrode having another configuration.

The present invention is not restricted to the above embodiments. The present invention can use various other configurations as long as they do not departed from the gist of the present invention.

According to the present invention, it is possible to supply focus voltages through two lines. Therefore, the labor for adjusting a focus voltage is simplified.

Moreover, according to the present invention, either or both of red and blue electron beams is or are not deteriorated in spot shape at the center or Y-axis ends of a screen, and it is possible to compensate for the deterioration of spot shapes of red and blue electron beams at the four corners of the screen.

Therefore, in a color cathode-ray tube, it is possible to obtain a high image quality also at the four corners, center, and Y-axis ends of a screen.

Having described preferred embodiments of the present invention with reference to the accompanying drawings, it is to be understood that the present invention is not limited to the above-mentioned embodiments and that various changes and modifications can be effected therein by one skilled in the art without departing from the spirit or scope of the present invention as defined in the appended claims.

What is claimed is:

1. A color-cathode-ray-tube electron gun comprising a three-divided first focus electrode and a second focus electrode set so as to face the first focus electrode, wherein a voltage having a parabolic waveform synchronizing with horizontal scanning is applied to the second focus electrode, a built-in resistor is included which electrically connects a central electrode and both outside electrodes among the three-divided first focus electrode, a voltage on which a first voltage component having a waveform similar to a serration synchronizing with horizontal scanning and a second voltage component having a parabolic waveform which is convex in the opposite direction to the former parabolic waveform are superimposed is applied to the central electrode, and a voltage obtained by passing a voltage on which the first voltage component and the second voltage component are superimposed through the built-in resistor is applied to both outside electrodes.

2. The color-cathode-ray-tube electron gun according to claim 1, wherein in the three-divided focus electrode, one of the holes through which two outside electron beams among three electron beams pass is formed into a horizontally-long astigmatic shape and the other of the holes is formed into a vertically-long astigmatic shape by the faced divided focus electrode, and inside of the same focus electrode, one of holes through which the outside electron beams pass is formed into a horizontally-long astigmatic shape and the other of the holes through which the outside electron beams pass is formed into a vertically-long astigmatic shape.

3. The color-cathode-ray-tube electron gun according to claim 1, wherein in the three-divided focus electrode, one of the holes through which two outside electron beams among three electron beams pass is formed so as to have a large diameter and the other of the holes is formed so as to have a small diameter by the faced divided focus electrode, and inside of the same focus electrode, one of holes through which the outside electron beams pass is formed so as to have a large diameter and the other of the holes through which the outside electron beams pass is formed so as to have a small diameter.

4. The color-cathode-ray-tube electron gun according to claim 1, wherein in the three-divided focus electrode, one of the electrodes around holes through which two outside electron beams among three electron beams pass is formed thick and the other of the electrodes around the holes is formed thin by the faced divided focus electrode, and inside of the same focus electrode, the circumference of one of holes through which the outside electron beams pass is formed thick and the circumference of the other of the holes through which the outside electron beams pass is formed thin.

5. A color cathode-ray tube constituted by having an electron gun comprising a three-divided first focus electrode, and a second focus electrode set so as to face the first focus electrode, wherein a voltage having a parabolic waveform synchronizing with horizontal scanning is applied to the second focus electrode, a built-in resistor is included which electrically connects a central electrode and both outside electrodes among the three-divided first focus electrode, a voltage on which a first voltage component having a waveform similar to a serration synchronizing with horizontal scanning and a second voltage component having a parabolic waveform which is convex in the opposite direction to the former parabolic waveform are superimposed is applied to the central electrode, and a voltage obtained by passing a voltage on which the first voltage component and the second voltage component are superimposed through the built-in resistor is applied to the both outside electrodes.

6. The color cathode-ray tube according to claim 5, wherein in the three-divided focus electrode, one of the holes through which two outside electron beams among three electron beams pass is formed into a horizontally-long astigmatic shape and the other of the holes is formed into a vertically-long astigmatic shape by the faced divided focus electrode, and inside of the same focus electrode, one of holes through which the outside electron beams pass is formed into a horizontally-long astigmatic shape and the other of the holes through which the outside electron beams pass is formed into a vertically-long astigmatic shape.

7. The color cathode-ray tube according to claim 5, wherein in the three-divided focus electrode, one of the holes through which two outside electron beams among three electron beams pass is formed so as to have a large diameter and the other of the holes is formed so as to have a small diameter by the faced divided focus electrode and inside of the same focus electrode, one of holes through which the outside electron beams pass is formed so as to have a large diameter and the other of the holes through which the outside electron beams pass is formed so as to have a small diameter.

8. The color cathode-ray tube according to claim 5, wherein in the three-divided focus electrode, one of the electrodes around holes through which two outside electron beams among three electron beams pass is formed thick and the other of the electrodes around the holes is formed thin by the faced divided focus electrode and inside of the same focus electrode, the circumference of one of holes through which the outside electron beams pass is formed thick and the circumference of the other of the holes through which the outside electron beams pass is formed thin.

* * * * *